US005634232A

United States Patent [19]

Brenneman

[11] Patent Number: 5,634,232

[45] Date of Patent: Jun. 3, 1997

[54] SWIMMING POOL TILE BRUSH

[76] Inventor: Ronald L. Brenneman, 306 Center St., Brighton, Mich. 48116

[21] Appl. No.: 619,367

[22] Filed: Mar. 21, 1996

[51] Int. Cl.[6] ..... A46B 15/00; E04H 4/16

[52] U.S. Cl. ..... 15/160; 15/1.7; 15/143.1; 15/145; 15/176.1

[58] Field of Search ..... 15/1.7, 143.1, 15/145, 159.1, 160, 176.1, 176.6

[56] References Cited

U.S. PATENT DOCUMENTS

| | | | |
|---|---|---|---|
| 1,315,194 | 9/1919 | Yamamoto | 15/143.1 X |
| 2,083,134 | 6/1937 | Wood | 15/160 |
| 2,753,579 | 7/1956 | Kussmann | 15/145 |
| 2,817,867 | 12/1957 | Bugbird | 15/145 X |
| 3,296,693 | 1/1967 | Fortune | 15/160 X |
| 4,247,216 | 1/1981 | Pansini | 15/1.7 X |
| 4,447,927 | 5/1984 | Malless, Jr. | 15/145 X |
| 4,479,277 | 10/1984 | Gilman et al. | 15/111 |
| 4,763,377 | 8/1988 | Madsen | 15/144.2 |
| 4,809,388 | 3/1989 | Dietrich | 15/143.1 |
| 5,105,752 | 4/1992 | Pompei et al. | 15/160 X |

FOREIGN PATENT DOCUMENTS

| | | | |
|---|---|---|---|
| 567096 | 5/1958 | Belgium | 15/143.1 |
| 467471 | 3/1914 | France | 15/160 |
| 695139 | 10/1928 | France | 15/160 |
| 721784 | 6/1942 | Germany | 15/145 |
| 958 | of 1899 | United Kingdom | 15/160 |
| 1418462 | 12/1975 | United Kingdom | 15/160 |

*Primary Examiner*—Mark Spisich
*Attorney, Agent, or Firm*—Alvin S. Blum

[57] ABSTRACT

A brush for scrubbing the side walls and gutter of a swimming pool provides enhanced access of the bristles to relatively inaccessible areas. An elongate straight pole handle allows the user to stand beside the pool while scrubbing. Bristles extend from a front face of a base member at various angles so that they project beyond the forward and side edges of the base to reach areas without interference from the base member. The base member is mounted on the pole so that the long axis of the pole passes behind the base member. This structure positions the bristles closer to the user while holding the pole vertically, to scrub the side wall without interference from overhanging coping at the top of the pool.

9 Claims, 1 Drawing Sheet

SWIMMING POOL TILE BRUSH

BACKGROUND OF THE INVENTION

This invention relates to swimming pool cleaning accessories, and more particularly to a brush especially adapted for scrubbing the vertical pool tile surface at the water level while standing beside and above the pool.

An in-ground swimming pool is provided with controls to maintain the water level at a particular height or the operator controls the water level manually so that the water surface at the pool sides reaches the gutter.

The pool water circulation system pulls the gutter water into the filter and returns it to the pool. This ensures that floating dirt, debris, scum, oil, and grease will be promptly removed. However, some of this contaminating material sticks to the pool wall at the water surface and must be periodically cleaned off. This surface is generally provided with large, smooth tiles to facilitate the cleaning process. Long handled stiff bristle brushes are provided so that the user can stand on the coping at poolside, reach over the edge and scrub that surface without getting into the pool. Unfortunately, use of the brush requires an awkward position at the pool edge, and the brush handle hits the top of the tiles unless the operator is reaching forward. Furthermore, cleaning the corners and the joint of the side wall with the gutter bottom is very difficult with these brushes, since the brush backing interferes with reaching into these corners.

SUMMARY OF THE INVENTION

It is accordingly an object of the invention to provide a swimming pool tile brush that can be more easily used by an operator to scrub the side wall of the gutter and the corners while standing beside the edge of the pool.

The brush of the invention has an elongate handle so that the operator does not have to bend over or kneel. The handle has a bend so that the brush head is better angled toward the wall. The brush head has longer and softer bristles and the bristles at the sides and distal end of the brush head are set in the brush at an angle to the central bristles so that bristle ends of the brush cover a much larger surface than the brush block in which the bristles are mounted. The angled bristles enable the bristle ends to reach into the corners without interference from the block supporting the bristles.

These and other objects, advantages and features of the invention will become more apparent when the detailed description is studied in conjunction with the drawings.

DETAILED DESCRIPTION OF PREFERRED EMBODIMENTS

Figures 1, 1A, 2, 3, 3A, 4, 5, 6, 7, 8, 9, 10:
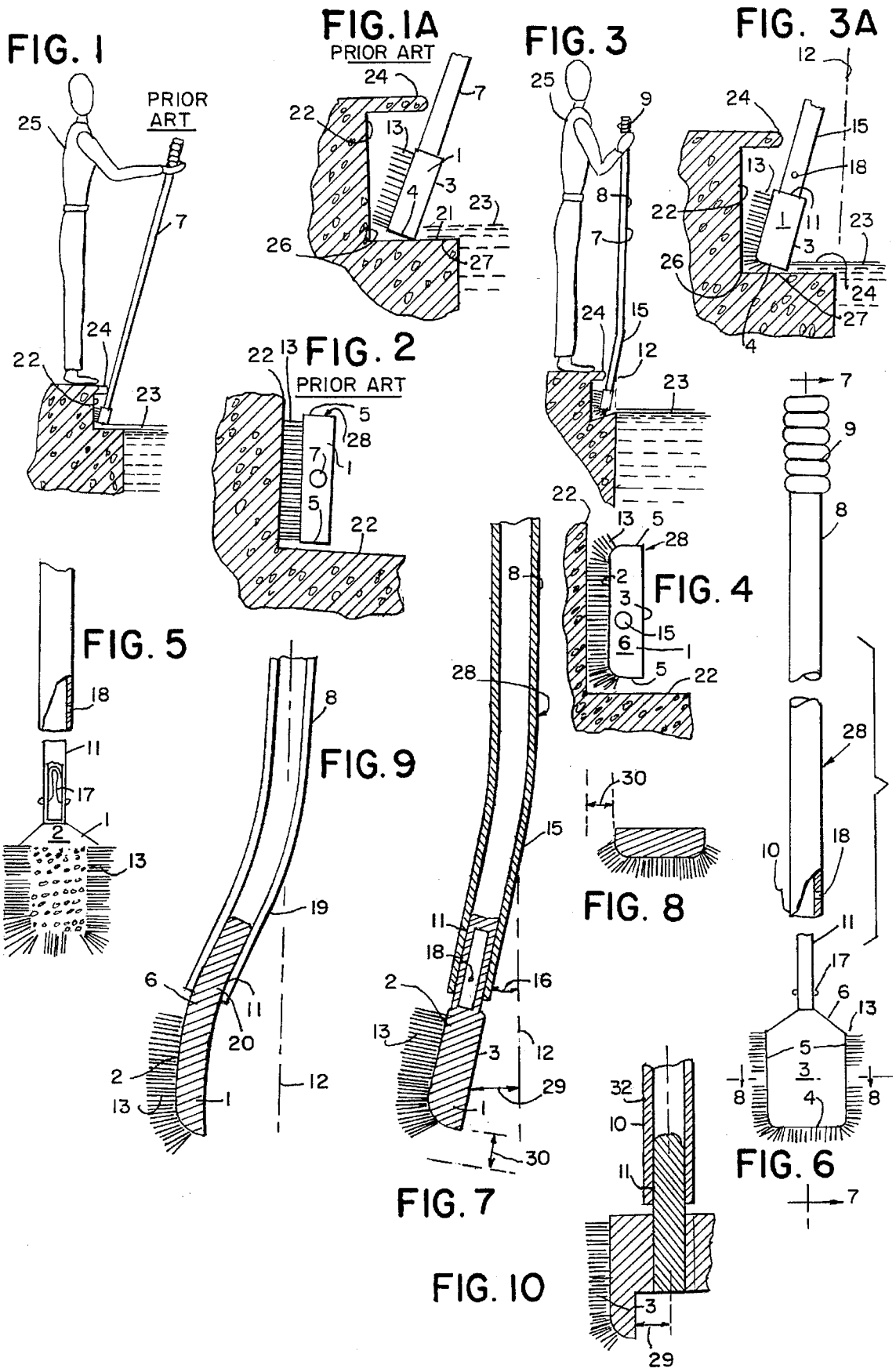
FIG. 1 PRIOR ART
FIG. 1A PRIOR ART
FIG. 2 PRIOR ART
FIG. 1 shows diagrammatically the operation of a brush of the prior art at a gutter.
FIG. 2 shows diagrammatically the operation of a brush of the prior art at a corner.
FIG. 3 shows diagrammatically the operation of the brush of the invention at a gutter.
FIG. 4 shows diagrammatically the operation of a brush of the invention at a corner.
FIG. 5 shows a front plan view of the brush.
FIG. 6 shows a rear plan view of the brush with handle.
FIG. 7 is a sectional view taken through line 7—7 of FIG. 6.
FIG. 8 is a sectional view taken through line 8—8 of FIG. 6.
FIG. 9 is a sectional view as in FIG. 7 of another embodiment of the invention.
FIG. 10 is a sectional view as in FIG. 7 of another embodiment of the invention.
FIG. 1*a* is an enlarged detail of a portion of FIG. 1.
FIG. 3*a* is an enlarged detail of a portion of FIG. 3.

Referring now first to FIGS. 1 and 1*a* showing a user 25 using a conventional brush to scrub a swimming pool gutter 21. Most of the tile side wall 22 is accessible, but the joint 26 where side wall 22 meets bottom of gutter 27 is difficult for bristles 13 to reach, because the straight pole 7 must be held at an angle to the vertical to avoid the overhang 24 found at the top of many pools. The forward edge 4 of the base member 1 interferes with the gutter bottom 27 so that the bristles 13 cannot effectively scrub the joint 26 which may contain dirt deposits from the water surface 23.

Referring now to FIGS. 3 and 3*a*, the brush of the invention has an elongate tubular pole 7 with a handle 9 at a straight distal portion 8 which may be held vertical while conveniently reaching the joint 26 because there is an intermediate portion 15 connected at an angle to the axis 12 of the straight portion, bringing the bristles 13 toward the user 25. The bristles 13 extend from the base 1 not only perpendicular to front face 2 but also extend at an angle to the front face so that the bristles project beyond the forward edge 4 of the base at least 1.25 centimeters to thereby reach the joint 26 without interference from the base member when used in combination with the bent pole.

Referring now to FIG. 2 showing a brush 28 of the prior art attempting to scrub a corner where two vertical gutter side walls 22 join. The side edge 5 of the base member 1 interferes with efforts to force the bristles 13 into the corner. As shown for comparison in FIG. 4, bristles 13 of the invention are supported in base member 1 at an angle to front face 2 along the sides so that the bristle ends extend beyond the side edges 5 of the base member at least 1.25 centimeters. Consequently the joint may be effectively reached and scrubbed by the brush 28 without interference from the base member while held comfortably by the user.

Referring now to FIGS. 5–8, a preferred embodiment of the brush 28 of the invention is shown. An elongate aluminum tube has a straight distal portion 8 with handle 9. An intermediate portion 15 joins the straight portion at an angle 16 of between five and 10 degrees. The proximal end 10 of pole 7 is provided with attaching means 11 for removably connecting base member i at its rear edge 6. Base member 1 has side edges 5, forward edge 4, back face 3 and front face 2. Bristles 13 extend at least 3.5 centimeters from the base member 1 and project from the front face 2 at various angles so that they project beyond the side edges 5 and the forward edge 4 a distance 30 of at least 1.2 centimeters. As shown, the central axis 12 of the straight distal portion 8 of the pole passed behind the back face 3 of the base member a distance 29 of at least 4 centimeters. The removable attaching means 11 of pole proximal end 10 to base member 1 may be any of the well known attaching means. Shown here is a plastic spring clip 17 forming spring loaded ends which engage perforations 18 in the pole. This attachment is well known in the swimming pool apparatus art.

Referring now to FIG. 9, another embodiment is shown in which the long straight distal portion 8 of the pole is joined to an arcuate intermediate portion 19. The attaching means 11 for connecting the base member 1 comprises a cylindrical plug 20 permanently fixed inside the pole. The plug 20 projects from rear edge 6 of base member 1 at an angle so that the front face 2 of the base member is substantially parallel to the long axis 12 and spaced apart therefrom for more efficient contact of bristles 13 with a scrubbing surface. Permanent fixing of plug 20 in the pole may be by any of the well known fastening means.

Referring now to FIG. 10, another embodiment of the invention is shown for use with a straight pole 32 in which the base member 1 is provided with a mounting assembly 31 attached to its back face 3 to provide means 11 for attaching to the pole proximal end 10 so that the axis 12 of the pole extends a distance 29 of at least four centimeters behind the back face 3 and parallel to the front face. Attaching means 11 may be any of the removable or permanent means well known in the art.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A brush for scrubbing the side wall of a swimming pool gutter, comprising:

A) a base member having broad front and back faces, a narrow forward edge, narrow side edges and a narrow rear edge, said edges joining said front and back faces;

B) an elongate pole having a straight distal portion with a long first axis, said pole provided at a proximal end with attacking means for connecting to said base member, said pole, when attached, extending beyond said rear edge a distance of at least one meter, with said first axis lying at least four centimeters behind said rear face;

C) a plurality of straight bristles permanently attached to said base member, said bristles having free ends extending at least 3.5 centimeters from said base member in a plurality of directions so as to provide bristle ends extending at least 1.2 centimeters beyond said side edges, said forward edge and said front face.

2. The brush according to claim 1, in which said pole is provided with handle means for grasping at said distal portion.

3. The brush according to claim 2, in which said pole has a straight intermediate portion connected at an angle of between five and ten degrees to said distal portion.

4. The brush according to claim 3, in which said attaching means removably connects said base member to said pole.

5. The brush according to claim 3, in which said attaching means permanently connects said base member to said pole.

6. The brush according to claim 2, in which said pole is provided with an arcuate intermediate portion joining said distal portion to said proximal end.

7. The brush according to claim 6, in which said attaching means removably connects said base member to said pole.

8. The brush according to claim 6, in which said attaching means permanently connects said base member to said pole.

9. The brush according to claim 2, in which said pole is tubular.

* * * * *